US006554391B1

(12) United States Patent
Sharma et al.

(10) Patent No.: US 6,554,391 B1
(45) Date of Patent: Apr. 29, 2003

(54) ROTATING DISK CLEANING ASSEMBLY APPARATUS AND METHOD FOR AN INK JET PRINT HEAD WITH FIXED GUTTER

(75) Inventors: Ravi Sharma, Fairport, NY (US); Todd R. Griffin, Rochester, NY (US); Charles F. Faisst, Avon, NY (US)

(73) Assignee: Eastman Kodak Company, Rochester, NY (US)

( * ) Notice: Subject to any disclaimer, the term of this patent is extended or adjusted under 35 U.S.C. 154(b) by 79 days.

(21) Appl. No.: 09/619,999

(22) Filed: Jul. 20, 2000

(51) Int. Cl.[7] ..... B41J 2/165
(52) U.S. Cl. ..... 347/22; 347/28; 347/33
(58) Field of Search ..... 347/22, 28, 33

(56) References Cited

U.S. PATENT DOCUMENTS

| | | | | |
|---|---|---|---|---|
| 4,401,990 A | * | 8/1983 | Aiba et al. | 347/32 |
| 4,800,403 A | | 1/1989 | Accattino et al. | 346/140 |
| 4,829,318 A | | 5/1989 | Racicot et al. | 346/1.1 |
| 4,933,015 A | * | 6/1990 | White | 134/6 |
| 4,968,994 A | | 11/1990 | Hock et al. | 346/1.1 |
| 5,103,244 A | * | 4/1992 | Gast et al. | 347/33 |
| 5,574,485 A | * | 11/1996 | Anderson et al. | 134/1 |
| 5,614,930 A | | 3/1997 | Osborne et al. | 347/33 |
| 5,914,734 A | | 6/1999 | Rotering et al. | 347/28 |

FOREIGN PATENT DOCUMENTS

| | | | | |
|---|---|---|---|---|
| DE | 3042997 A | * | 7/1982 | B41J/3/04 |
| DK | 3042998 A1 | * | 1/1982 | B41J/3/04 |
| EP | 0988978 A1 | * | 3/2000 | B41J/2/165 |
| EP | 988978 A1 | * | 3/2000 | B41J/2/165 |
| JP | 63022656 | | 1/1988 | B41J/3/04 |
| JP | 59014964 | * | 1/1994 | B41J/3/04 |

* cited by examiner

*Primary Examiner*—John Barlow
*Assistant Examiner*—Leonard Liang
(74) *Attorney, Agent, or Firm*—Walter S. Stevens

(57) ABSTRACT

A self-cleaning printer system (400) with cleaning liquid (300) and cleaning mechanism (140) with a rotating disk cleaning assembly (32) can be used to remove contaminants from a print head (16) in the self-cleaning ink jet printer system (400). A rotating disk cleaning assembly (32) is disposed relative to the surface (15) of a print head (16) for directing a flow of cleaning liquid (300) along the surface (15) and to direct sliding contact of a disk (190) to clean the contaminants from the surface (15). The rotating disk cleaning assembly (32) is configured to introduce cleaning liquid (300) to the print head surface (15) to facilitate and augment cleaning by the disk (190). Flow of the cleaning liquid (300) is facilitated by vacuum pump (36) which directs cleaning liquid (300) from a cleaning liquid reservoir (270) to the rotating disk cleaning assembly (32).

26 Claims, 11 Drawing Sheets

ROTATING DISK CLEANING ASSEMBLY APPARATUS AND METHOD FOR AN INK JET PRINT HEAD WITH FIXED GUTTER

FIELD OF THE INVENTION

This invention generally relates to a self-cleaning ink jet printer and methods for cleaning the same, and more particularly to a rotating disk cleaning assembly for an ink jet printer having a fixed canopy-type gutter.

BACKGROUND OF THE INVENTION

An ink jet printer produces images by ejecting ink droplets onto a receiver medium in an image-wise fashion. The advantages of non-impact, low-noise, low energy use, and low cost operation in addition to the capability of the printer to print on plain paper mediums are largely responsible for the wide acceptance of ink jet printers in the marketplace.

"On demand" ink jet printers utilize a pressurization actuator to produce the ink jet droplet at orifices of a print head. In this regard, either one of two types of actuators may be used including heat actuators and piezoelectric actuators. With heat actuators, a heater placed at a convenient location heats the ink and a quantity of the ink will phase change into a gaseous steam bubble and raise the internal ink pressure sufficiently for an ink droplet to be expelled onto the recording medium. With respect to piezoelectric actuators, a piezoelectric material possessing properties such that an electric field is produced when a mechanical stress is applied. The converse also holds true; that is, an applied electric field will produce a mechanical stress in the material. Some naturally occurring materials possessing these characteristics are quartz and tourmaline. The most commonly produced piezoelectric ceramics are lead zirconate titanate, barium titanate, lead titanate, and lead metaniobate.

In the case of "continuous" ink jet printers, electrostatic charging tunnels are placed close to the point where ink droplets are being ejected in the form of a stream. Selected droplets are electrically charged by the charging tunnels. The charged droplets are deflected downstream by the presence of deflector plates that have a predetermined electric potential difference between them. A gutter may be used to intercept the charged droplets, while the uncharged droplets are free to strike the recording medium.

Recently a new type of continuous ink jet printer has been disclosed. U.S. Pat. Nos. 6,079,821 and 6,234,620 issued to Chwalek et al. and Faisst, Jr. et al., respectively, describe a continuous ink jet printer in which on demand asymmetric heating of an ink jet causes selected drops to deflect. In one mode of operation, selected drops are deflected toward an image-recording medium while the other drops are intercepted in a canopy-type gutter that is placed in close proximity (for example, 3 mm) to the ink jet nozzle plate.

Inks for high-speed ink jet printers, whether of the "continuous" or "piezoelectric" type, must have a number of special characteristics. For example, the ink should incorporate a nondrying characteristic, so that drying of ink in the ink ejection chamber is hindered or slowed to such a state that by occasional spitting of ink droplets, the cavities and corresponding nozzles are kept open. The addition of glycol facilitates free flow of ink through the ink jet chamber. Of course, the ink jet print head is exposed to the environment where the ink jet printing occurs. Thus, the previously mentioned nozzles are exposed to many kinds of air born particulates. Particulate debris may accumulate on surfaces formed around the nozzles and may accumulate in the nozzles and chambers themselves. That is, the ink may combine with such particulate debris to form an interference burr that blocks the nozzle or that alters surface wetting to inhibit proper formation of the ink droplet. The particulate debris should be cleaned from the surface and nozzle to restore proper droplet formation. In the prior art, this cleaning is commonly accomplished by brushing, wiping, spraying, vacuum suction, and/or spitting of ink through the nozzle.

Thus, ink jet printers can be said to have the following problems: the inks tend to dry-out in and around the nozzles resulting in clogging of the nozzles; and the wiping of the nozzle plate causes wear on plate and wiper, the wiper itself producing particles that clog the nozzle. In addition, cleaning an ink jet nozzle plate that has limited accessibility due to the placement of a fixed gutter poses extra demands on the design of cleaning members and on methods used.

Ink jet print head cleaners are known. For example, a print head wiping system for ink jet print heads is disclosed in U.S. Pat. No. 5,614,930, entitled "Orthogonal Rotary Wiping System For Ink jet Printheads" issued Mar. 25, 1997 in the name of William S. Osborne et al. The Osborne et al. patent discloses a rotary service station, which incorporates a wiper-supporting tumbler. The tumbler rotates to wipe the print head along a length of a linearly aligned nozzle. In addition, a wiper scraping system scrapes the wipers to clean the wipers. However, Osborne et al. do not disclose use of an external solvent to assist cleaning and also does not disclose complete removal of the external solvent. In addition, a wiper scraping system is limited by the size constraints imposed by the print head itself. This is particularly true for fixed gutter ink jet print head systems, which partially encloses the print head surfaces. Fixed gutter systems require a mechanism that can work within small tolerances imposed by the integrated gutter in order to clean the print head. The Osborne et al. cannot tolerate the stresses demanded by the tight spacing and limited size of current ink jet print heads.

Therefore, there is a need to provide a suitable ink jet printer with a cleaning mechanism, and method of assembling the same, wherein the cleaning mechanism is capable of cleaning the print head surface within the confines of small tolerances and limited spacing. There is also a need to supply cleaning liquid to lubricate and aid cleaning in a manner that does not cause wear of the print head nozzle plate. Furthermore, there is a need for a cleaning mechanism that can operate within the limited spacing imposed by an fixed canopy-type gutter.

SUMMARY OF THE INVENTION

It is an object of the present invention to provide a self-cleaning ink jet printer with a cleaning mechanism and method of assembling the same, wherein a surface of a print head belonging to the printer is effectively cleaned.

It is another object of the present invention to provide an ink jet print head assembly that includes a cleaning mechanism and method of assembling the same that can be utilized in fixed gutter continuous ink jet printers.

With the above objects in view, disclosed is a cleaning mechanism composed of a rotating disk cleaning assembly for use in a self-cleaning printer. The self-cleaning printer includes a print head having a print head surface and an ink channel therein, and a structural member that functions as a gutter for collecting ink disposed opposite to the print head surface. The cleaning mechanism is adapted to clean contaminant from the print head surface.

According to an exemplary embodiment of the present invention, a self-cleaning printer is disclosed, wherein the self-cleaning printer includes a print head defining a plurality of ink channels therein, each ink channel terminating in a nozzle. The print head also has a surface thereon surrounding all the nozzles. The print head is capable of jetting ink through the nozzles, such that ink jets are subsequently heated to cause ink drops to form and to selectively deviate for printing. Ink drops are intercepted by either a receiver or a gutter. In one method of operation, ink is selectively deflected onto a receiver (e.g., paper or transparency) supported by a platen disposed adjacent the print head, while the non-deflected ink drops are intercepted by the gutter.

Ink intercepted by the gutter may be recycled. Contaminant such as an oily film-like deposit or particulate matter may reside on the surface and may completely or partially obstruct the nozzle. The oily film may be, for example, grease and the particulate matter may be particles of dirt, dust, metal and/or encrustations of dried ink. Presence of the contaminant interferes with proper ejection of the ink droplets from their respective nozzles and therefore may give rise to undesirable image artifacts, such as banding. It is therefore desirable to clean the contaminant from the surface and the nozzles.

Therefore, a cleaning mechanism is disposed relative to the surface and/or the nozzle, such that a flow of cleaning liquid may be directed along the surface and/or across the nozzle. The cleaning mechanism is disposed relative to the surface and/or the nozzle so as to direct a rotating disk cleaning assembly to clean the contaminant from the surface and/or nozzle via contact with the rotating disk cleaning assembly. As described in detail herein, ink delivered by the print head may be used as cleaning liquid. Ink squirted onto to the rotating disk is used to facilitate and augment cleaning by the rotating disk cleaning assembly. The rotating disk rotates by the rotating action of the internal rotating member, which in turn is connected to a driver that is driven by a motor. The rotating disk is surrounded by a soft and preferably porous covering. The rotating disk and soft covering upon sliding and rotating contact with a print head surface work together to remove contaminants from the print head surface. The soft covering surrounding the rotating disk also serves to hold contaminants and cleaning liquid during cleaning.

In another embodiment, cleaning liquid may be supplied to the print head surface through channels provided in the gutter. In yet another embodiment, the rotating disk cleaning assembly may be combined with an ultrasonic transducer.

A feature of the present invention is the provision of a rotating disk cleaning assembly with channels for liquid that fit in the restricted space between the print head surface and the gutter and is capable removing contaminant from the surface and/or nozzle.

Another feature of the present invention is the provision of a piping circuit to deliver and remove cleaning liquid from the print head surface.

Yet, another feature of the present invention is the provision of a mechanism to align and transport the rotating disk during cleaning operation.

Yet, another feature of the present invention is the provision of an ultrasonic transducer to energize the cleaning action by the rotating disk and the cleaning liquid.

An advantage of the present invention is that the cleaning assembly belonging to the invention cleans the contaminant from the surface and/or nozzle in the confined space between the print head surface and the fixed gutter.

These and other objects, features and advantages of the present invention will become apparent to those skilled in the art upon a reading of the following detailed description taken in conjunction with the appended drawings which show and describe illustrative embodiments of the invention.

BRIEF DESCRIPTION OF THE DRAWINGS

While the specification concludes with claims particularly pointing out and distinctly claiming the subject matter of the present invention, it is believed the invention will be better understood from the following detailed description taken in junction with the accompanying drawings wherein:

Numerals and parts in the detailed description correspond to like references in the figures unless otherwise indicated.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1A:
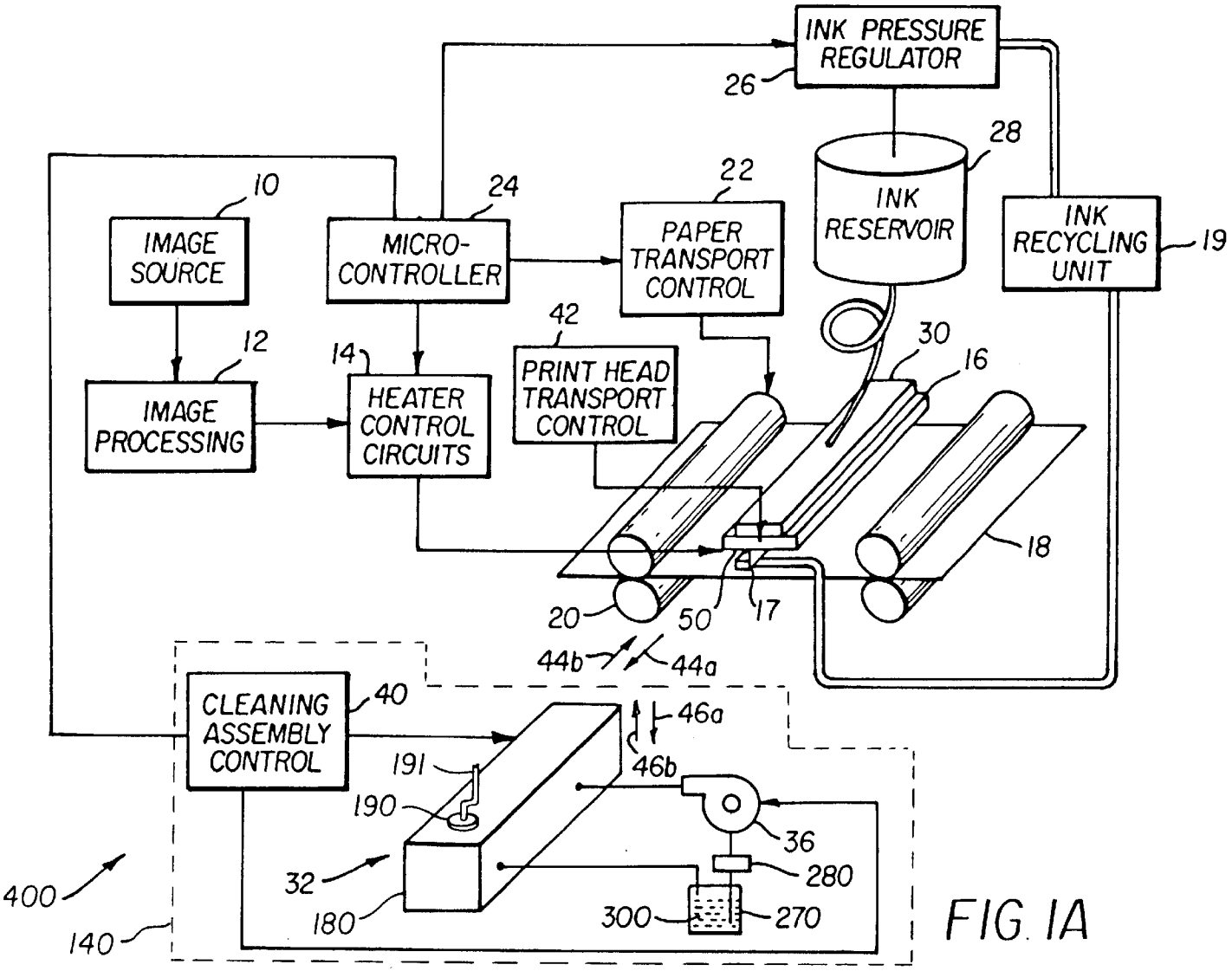
FIG. 1A is a simplified block schematic diagram of a first embodiment printer system equipped with a page width print head with fixed gutter and cleaning mechanism disposed adjacent to the print head.
Figure 1B:
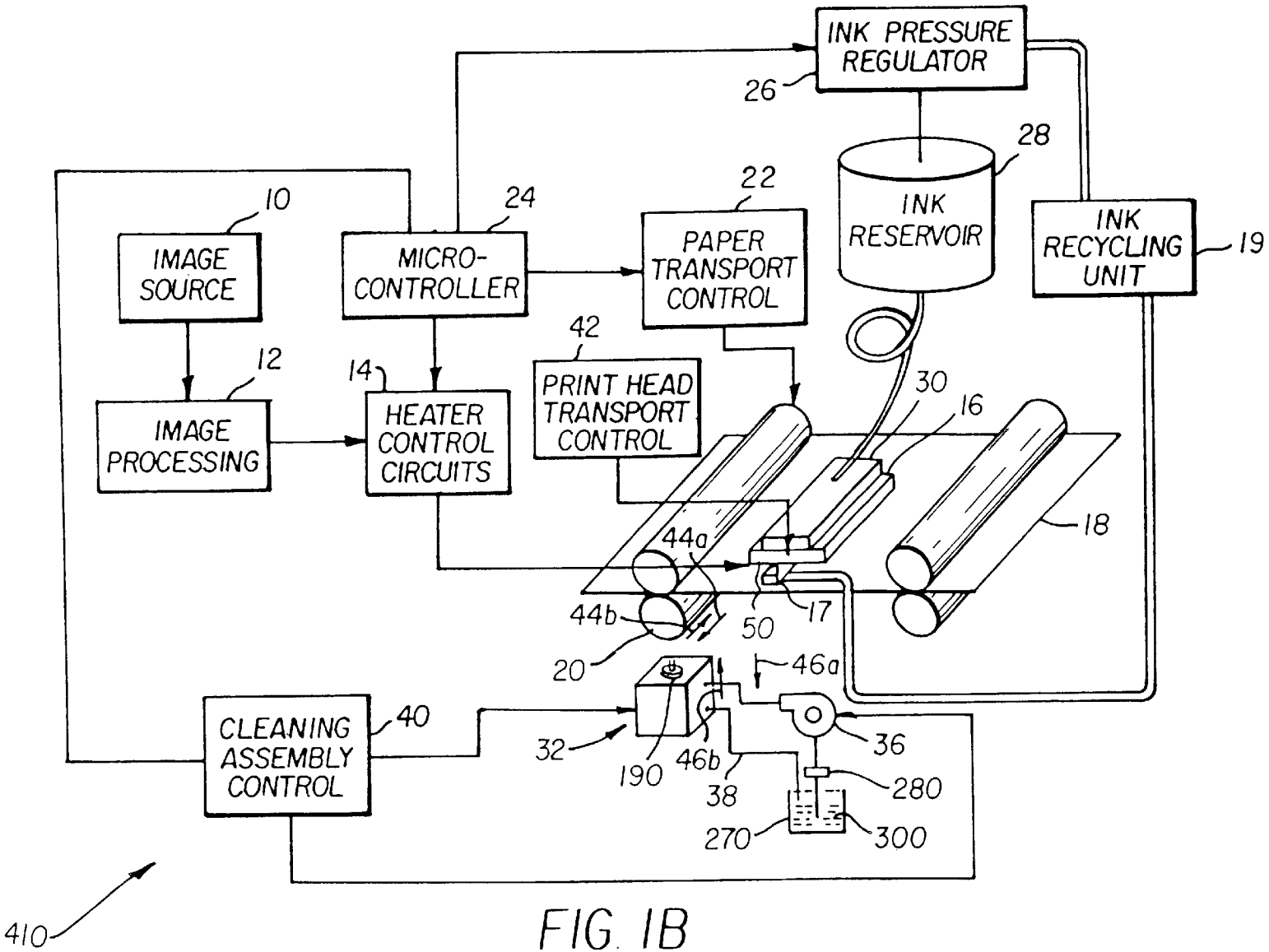
FIG. 1B is a simplified block schematic diagram of a first embodiment printer, the printer equipped with a reciprocating print head with fixed gutter and cleaning mechanism disposed adjacent to the print head.
Figure 3:
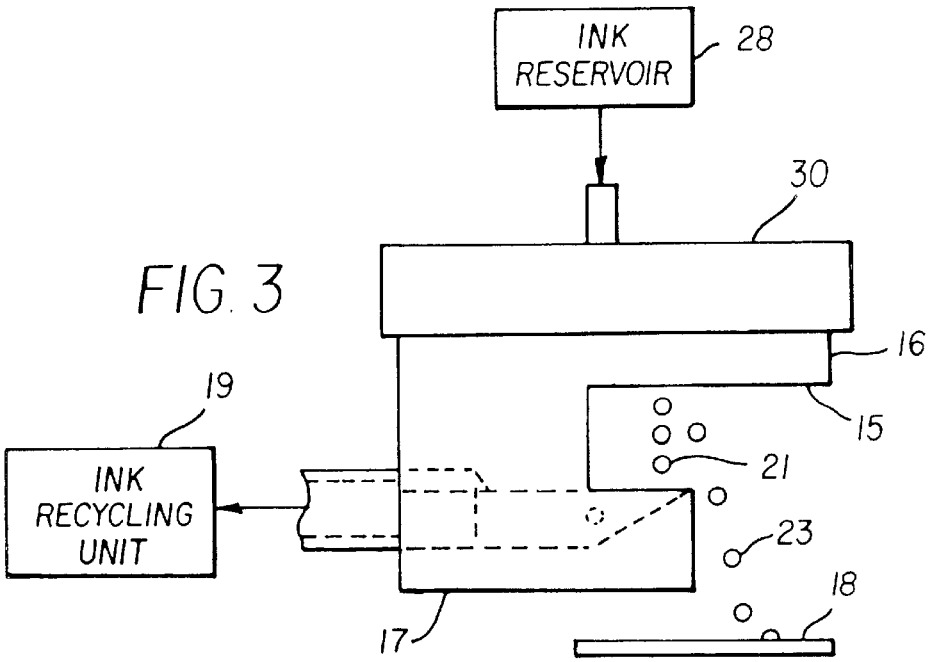
FIG. 3 is a side view of a print head according to the invention, showing deflected ink drops directed toward a receiving medium and non-deflected ink drops intercepted by the fixed gutter.

Therefore, referring to FIGS. 1A and 1B, therein are shown first and second examples of a first embodiment self-cleaning printer system denoted generally as 400 and 410, respectively, according to the invention. The self-cleaning printer systems 400 and 410 utilize an image source 10, such as a scanner or a computer, that provides the raster image data, outline image data in the form of a page description language, or other forms of digital image data. The image source 10 is converted to half-toned bitmap image data by an image-processing unit 12, which stores the image data in memory. A plurality of heater control circuits 14 read the data from memory within the image-processing unit 12 and apply time-varying electrical pulses to a set of nozzle heaters 50 that are part of a print head 16. The action of the nozzle heaters 50 (shown in FIGS. 4 and 5) and print head 16 during printing is shown in FIG. 3 wherein the electrical pulses are applied at an appropriate time, and to the appropriate nozzle, so that drops 23 form a continuous ink jet stream to create spots on a recording medium 18, typically paper, in an appropriate position designated by the data in the memory of the image processing unit 12. Non-deflected ink drops 21 formed in the non-printing area are intercepted by a gutter 17, which is fixed in relation to the print head 16.

Referring to FIGS. 1A and 1B, recording medium 18 is moved relative to the print head 16 by a recording medium transport system 20, which is electronically controlled by a paper transport control system 22, and which, in turn, is controlled by a micro-controller 24. The paper medium transport system 22 shown in FIGS. 1A and 1B is shown in schematic form only, and many different mechanical configurations are possible, as is known to those of skill in the art. For example, a transfer roller could be used as a paper medium transport system 22 to facilitate transfer of the ink drops 23 to recording medium 18. Such transfer roller technology is well known in the art. In the case of page width print heads, it is most convenient to move the recording medium 18 past a stationary print head. However, in the case of a scanning print system (as shown schematically in FIG. 1B), it is usually most convenient to move the print head along one axis (the sub-scanning direction) and the recording medium 18 along an orthogonal axis (the main scanning direction) in a relative raster motion.

Referring to FIGS. 1A, 1B, 3 and 4, ink is contained in an ink reservoir 28 under pressure. In the non printing state, continuous ink jet drop streams are unable to reach the recording medium 18 due to the position of gutter 17 that blocks the stream to allow a portion of the ink to be recycled by an ink recycling unit 19. The ink-recycling unit 19 reconditions the ink and feeds it back to ink reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

Figure 2:
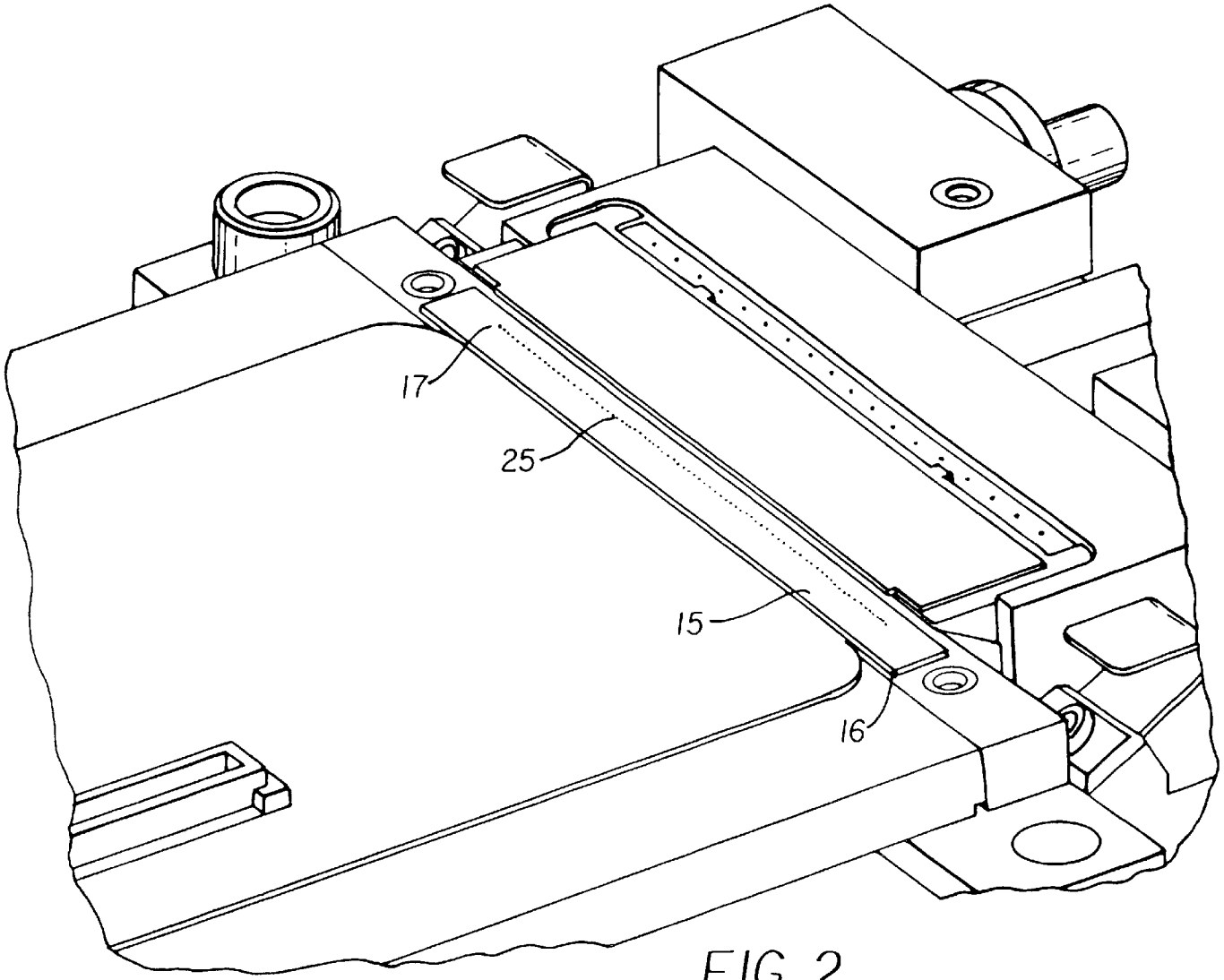
FIG. 2 is an isotropic view of the print head with fixed gutter, the print head defining a plurality of channels therein, each channel terminating in a nozzle.
Figure 4:
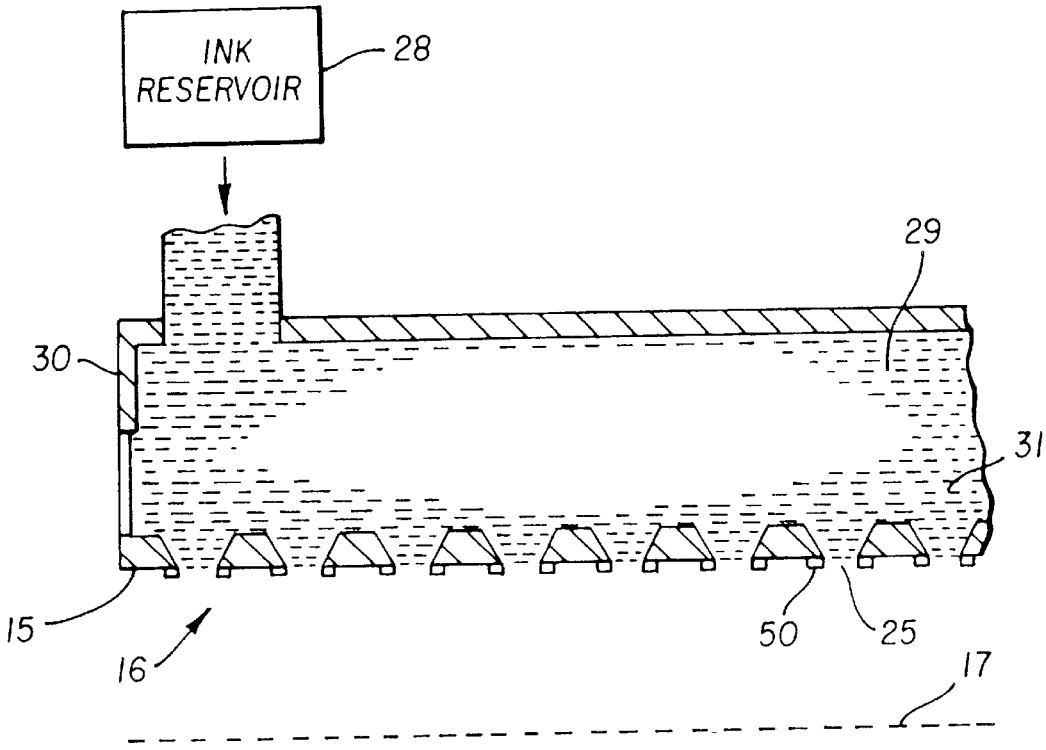
FIG. 4 is a fragmented view in cross-section of the print head shown in FIG. 3.

The ink is distributed to the back surface of the print head 16 by an ink channel device 30 and through ink channel 31, as shown in FIG. 4. The ink preferably flows through slots and/or holes etched through silicon substrate of print head 16 to its print head surface 15, where a plurality of nozzles 25 and heaters 50 are situated. FIG. 2 is an isotropic view of the print head 16 and gutter 17. With print head 16 fabricated from silicon, it is possible to integrate heater control circuits 14 with the print head 16. In operation, non-deflected ink drops 21 are intercepted by gutter 17, while deflected ink drops 23 land on the recording medium 18. Deflection may be caused by a variety of methods including the asymmetric heating method discussed in U.S. Pat. No. 6,079,821 issued to Chwalek et al.

Figure 5:
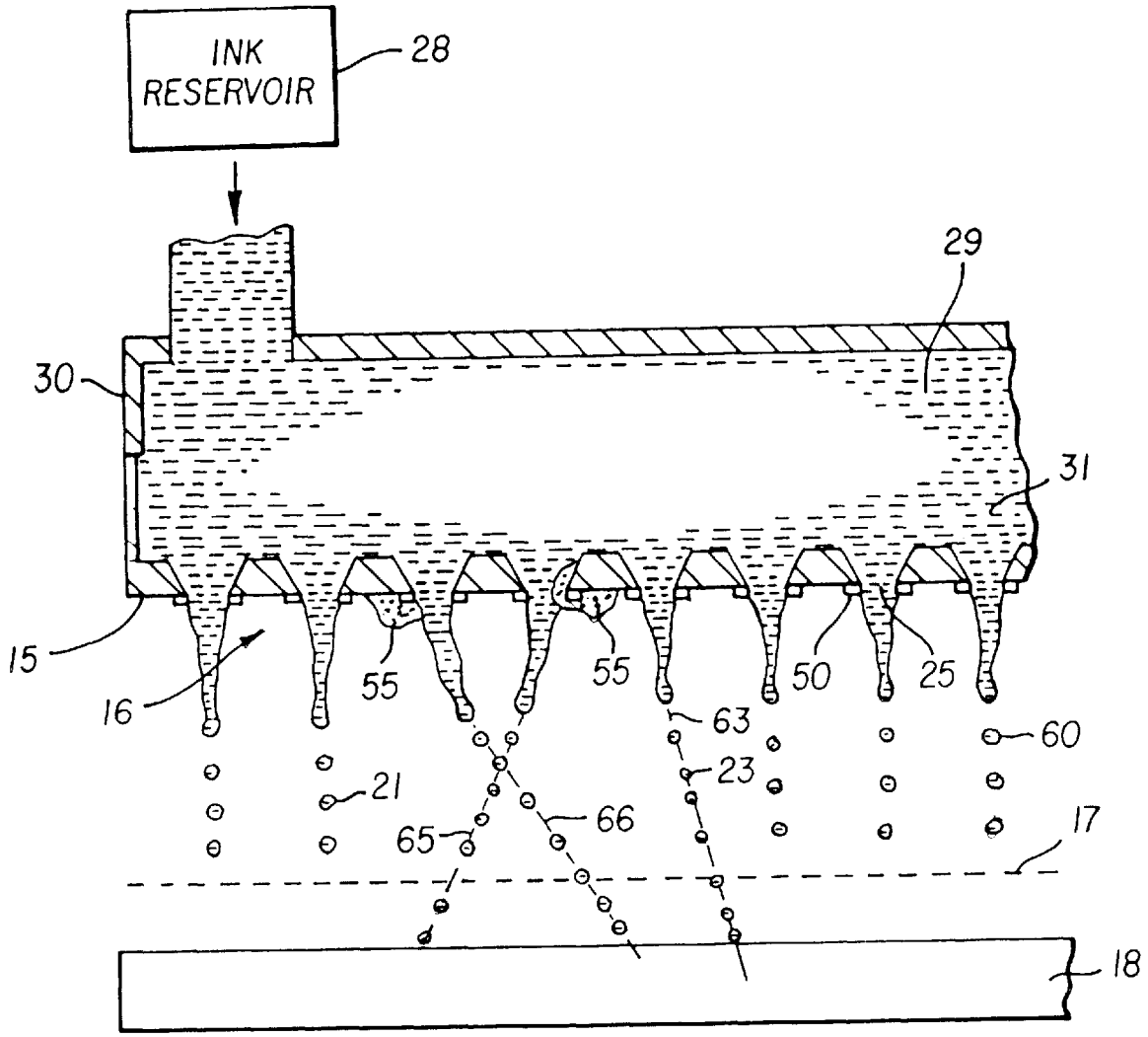
FIG. 5 is a fragmented view in cross-section of a contaminated print head with schematic representation of misaligned ink drops due to contamination.

Turning now to FIG. 5, it has been observed that the print head surface 15 may become fouled by contaminant 55. Contaminant 55 may be, for example, an oily film or particulate matter residing on the surface of print head surface 15. Contaminant 55 also may partially or completely obstructs one or more of the plurality of nozzles 25. The particulate matter may be, for example, particles of dirt, dust, metal and/or encrustations of dried ink. The oily film may be, for example, grease or the like. Presence of contaminant 55 is undesirable because when contaminant 55 completely obstructs one or more of the plurality of nozzles 25, ink is prevented from being ejected from nozzle 25. In this regard, the terms "nozzle" and "nozzles" are used interchangeably throughout either in the singular or plural as may be appropriate.

In addition, when contaminant 55 partially obstructs nozzle 25, flight of ink droplets 60 may be diverted from first axis 63 to travel along a second axis 65 (as shown). If ink droplets 60 travels along second axis 65, ink droplets 60 will land on recording medium 18 in an unintended location. In this manner, such complete or partial obstruction of nozzle 25 leads to printing artifacts such as "banding", a highly undesirable result. A similar printing artifact results if non-selected drops 21 travel on third axis 66. Also, the presence of contaminant 55 may alter surface wetting and inhibit proper formation of droplets 60. Therefore, it is desirable to clean (i.e., remove) contaminant 55 to avoid these and other printing artifacts.

Therefore, the self-cleaning printer systems 400 and 410 are equipped with a cleaning mechanism 140 that can be used for simultaneously removing contaminant 55 from the print head surface 15 of the print head 16 and the nozzles 25, according to the invention. In particular, the self-cleaning printer system 400 of FIG. 1A is of the page width print head variety, while self-cleaning printer system 410 of FIG. 1B illustrates a scanning type print head. The differences between a page width print head and a scanning type print head are well understood by those of ordinary skill. The cleaning mechanism 140 includes a rotating disk cleaning assembly 32, disposed for directing cleaning liquid 300 carried in or on a soft absorbent covering 195 on disk 190 to surface 15 and nozzles 25. Disk 190 moves along the print head surface 15 and across nozzles 25 to clean contaminant 55 therefrom. Disk 190 may be constructed of a soft absorbent material such as felt, polyurethane sponge or expanded polytetrafluroethylene so that cleaning liquid supplied to it is absorbed by the soft absorbent covering. During cleaning, cleaning liquid 300 in or on soft absorbent covering 195 provides chemical cleaning and lubrication between disk 190 and print head surface 15. Alternatively, disk 190 may be constructed of a stiff material such as plastic or metal coated with soft absorbent material 195. The stiff material 193 is perforated to allow cleaning liquid 300 supplied to it to wick through and get absorbed by soft absorbent covering 195. The cleaning liquid 300 mentioned hereinabove may be any suitable liquid solvent composition, such as ink, water, isopropanol, diethylene glycol, diethylene glycol monobutyl ether, octane, acids and bases, surfactant solutions and any combination thereof. Complex liquid compositions may also be used, such as microemulsions, micellar surfactant solutions, vesicles and solid particles dispersed in the cleaning liquid 300.

Figure 6:
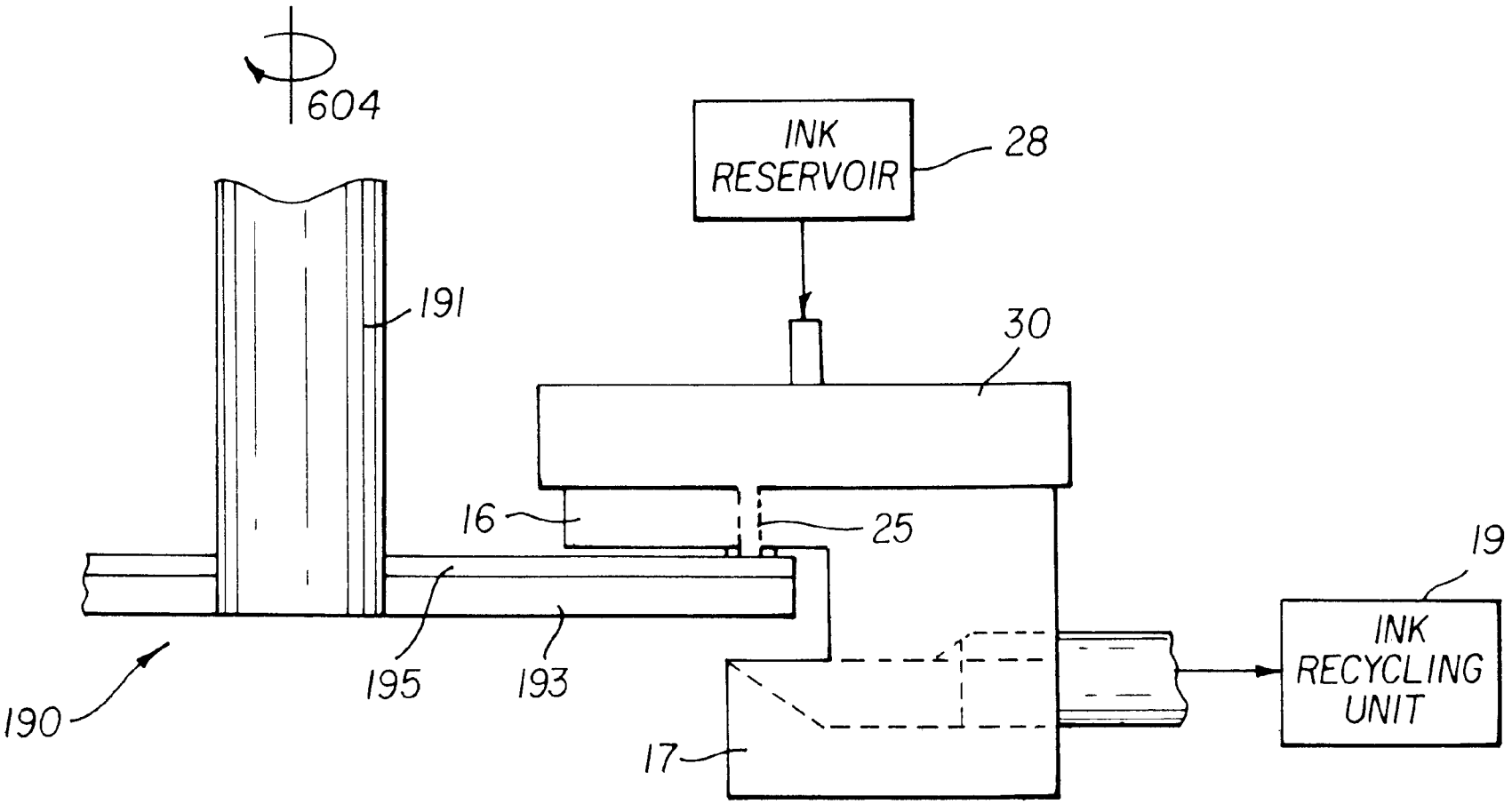
FIG. 6 is a perspective view of a rotating disk cleaning assembly having a rotating disk and shaft for removing contaminant from a print head surface, in accordance with a preferred embodiment of the present invention.

To better understand the implementation of print head cleaning assembly 32 and, in particular, the disk 190, reference is made to FIG. 6. FIG. 6 is a perspective view of a section of rotating disk cleaning assembly 32 having a disk 190 and a shaft 191 for removing contaminant from a print head surface 15, in accordance with a preferred embodiment of the present invention. The disk 190 can be constructed by laminating a perforated metal or plastic disk 193 with a soft absorbent material 195. Arrow 604 indicates the motion of disk 190 when driven by a motor (not shown) coupled to shaft 191. In first embodiment self-cleaning printer systems 400 and 410, cleaning liquid is supplied to the absorbent covering 195 through channels (not shown) in cleaning assembly block 180 prior to engagement of disk 190 with print head surface 15.

In operation, upon receiving an electronic signal from micro-controller 24 via cleaning assembly control 40, pump 36 is activated causing cleaning liquid 300 to be moved from cleaning liquid reservoir 270 through filter 280 and sprayed onto surface of disk 190. Cleaning assembly control 40 also activates disk motor (not shown) causing the disk 190 to rotate. Micro-controller 24 also sends as electronic signal to print head transport control 42, which causes print head 16 to assume a "maintenance" position by translating toward disk 190 following the direction of arrow 44*a*. Preferably, disk 190 is pre-aligned with print head surface 15 of print head 16 so that when print head 16 reaches disk 190, print head surface 15 and nozzles 25 are in contact with soft absorbent material 195 of disk 190. Thus, as print head 16 continues to travel along direction of arrow 44*a*, contaminant 55 on print head surface 15 and in nozzles 25 is removed by the disk 190. After cleaning, print head 16 is translated back along direction of arrow 44*b* to its normal printing position.

As can be appreciated by those of ordinary skill, the process of engaging disk 190 with print head surface 15 described above is one of many methods of using cleaning assembly 32 to clean print head surface 15 and nozzles 25. For example rather than having print head surface 15 moved towards disk 190, cleaning assembly 32 may be optionally equipped with its own translation capability wherein the cleaning assembly 32 moves from a "home" position to a cleaning position that enables the disk 190 to come into contact with the print head surface 15.

Figure 7:
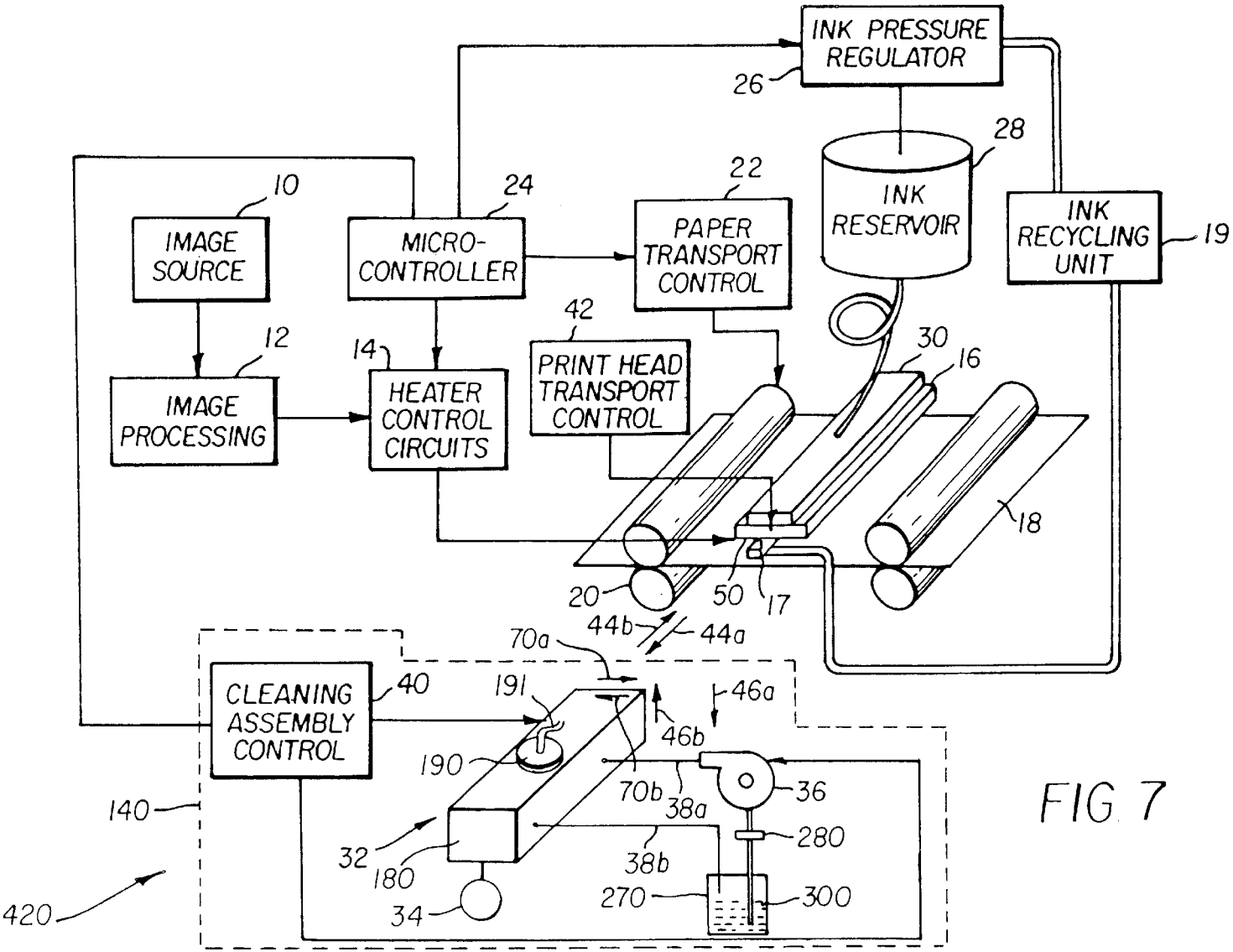
FIG. 7 is a simplified block schematic diagram of a second embodiment printer system equipped with a page width print head with fixed gutter and rotating disk cleaning assembly disposed adjacent to the print head.

Referring to FIG. 7, therein is shown an example of self cleaning ink jet printer system, denoted generally as 420 in which cleaning assembly 32 may be translated for the purpose of cleaning print head surface 15 and nozzles 25 of print head 16. By way of example only, print head cleaning assembly 32 may be supported on an elevator (not shown) and lifted in direction of arrow 46*b* to appropriate location in order to engage the disk 190 with print head surface 15 of print head 16. This corresponds to the cleaning position of the cleaning assembly 32. Similarly, translation of cleaning assembly 32 along arrows 70*a* and 70*b* may also be utilized to aid optimal engagement of disk 190 with print head surface 15 of print head 16. After print head surface 15 and nozzles 25 have been cleaned, print head 16 is translated back to its printing position, and print head cleaning assembly 32 is lowered to its rest or home position along arrow 46*a*.

When required, disk 190 may be replaced or cleaned. Disk 190 may be cleaned using cleaning liquid supply to cleaning assembly block 180. For example, cleaning liquid 300 may be suctioned from the cleaning liquid reservoir 270 and directed through piping segment 38*a* and squirted onto disk 190 during cleaning. Used cleaning liquid can be returned to cleaning liquid reservoir 270 via piping segment 38*b*. Alternatively, a mechanism (not shown) may be provided to lower disk 190 so that it is in contact with vacuum slots (not shown) provided in cleaning assembly block 180. Cleaning liquid 300 supplied to disk 190 by pump 36 may now be sucked away by vacuum pump 34.

Figure 8:
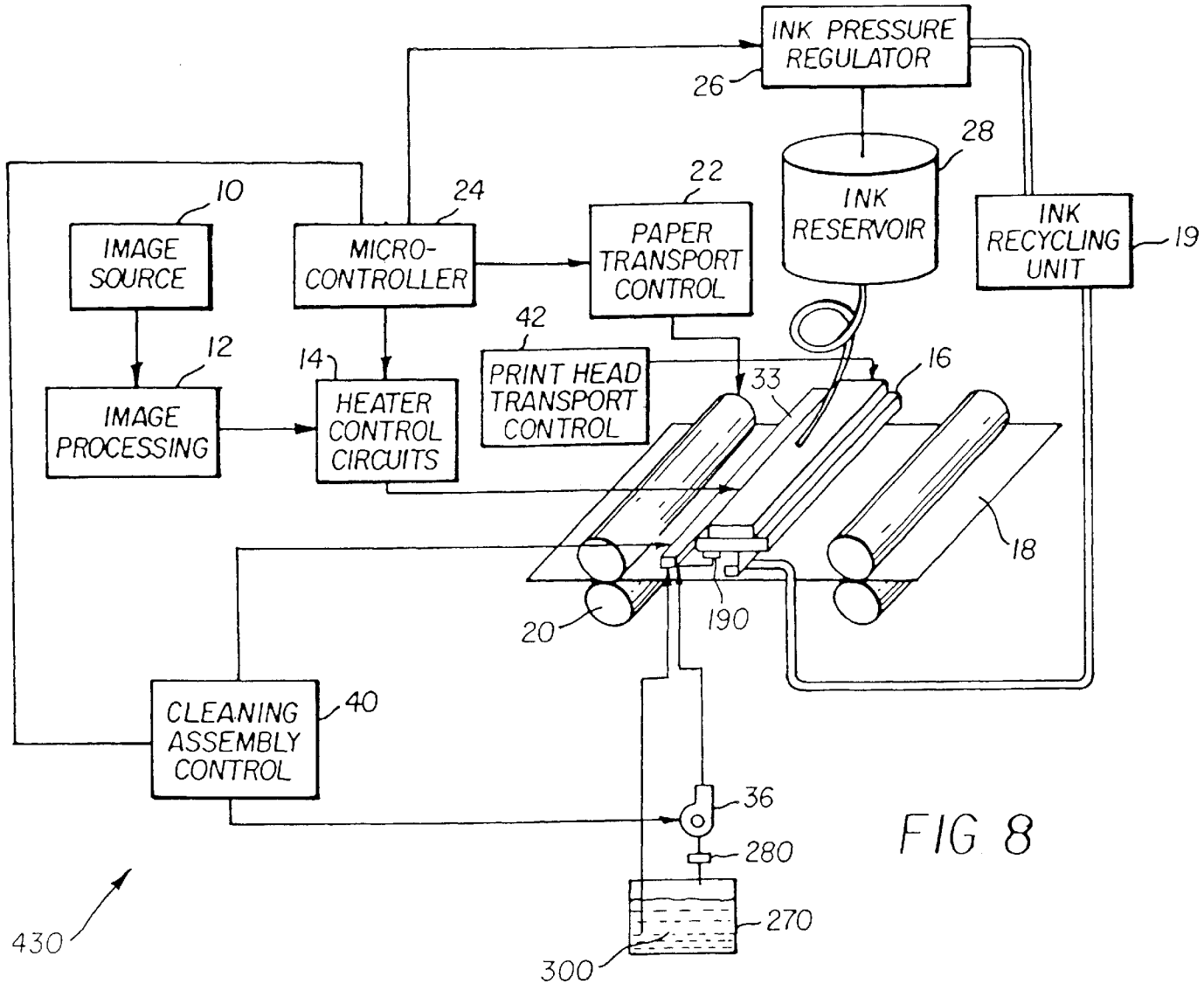
FIG. 8 is a simplified block schematic diagram of a third embodiment printer equipped with a reciprocating print head with fixed gutter and cleaning mechanism disposed on the same block as print head.
Figure 9:
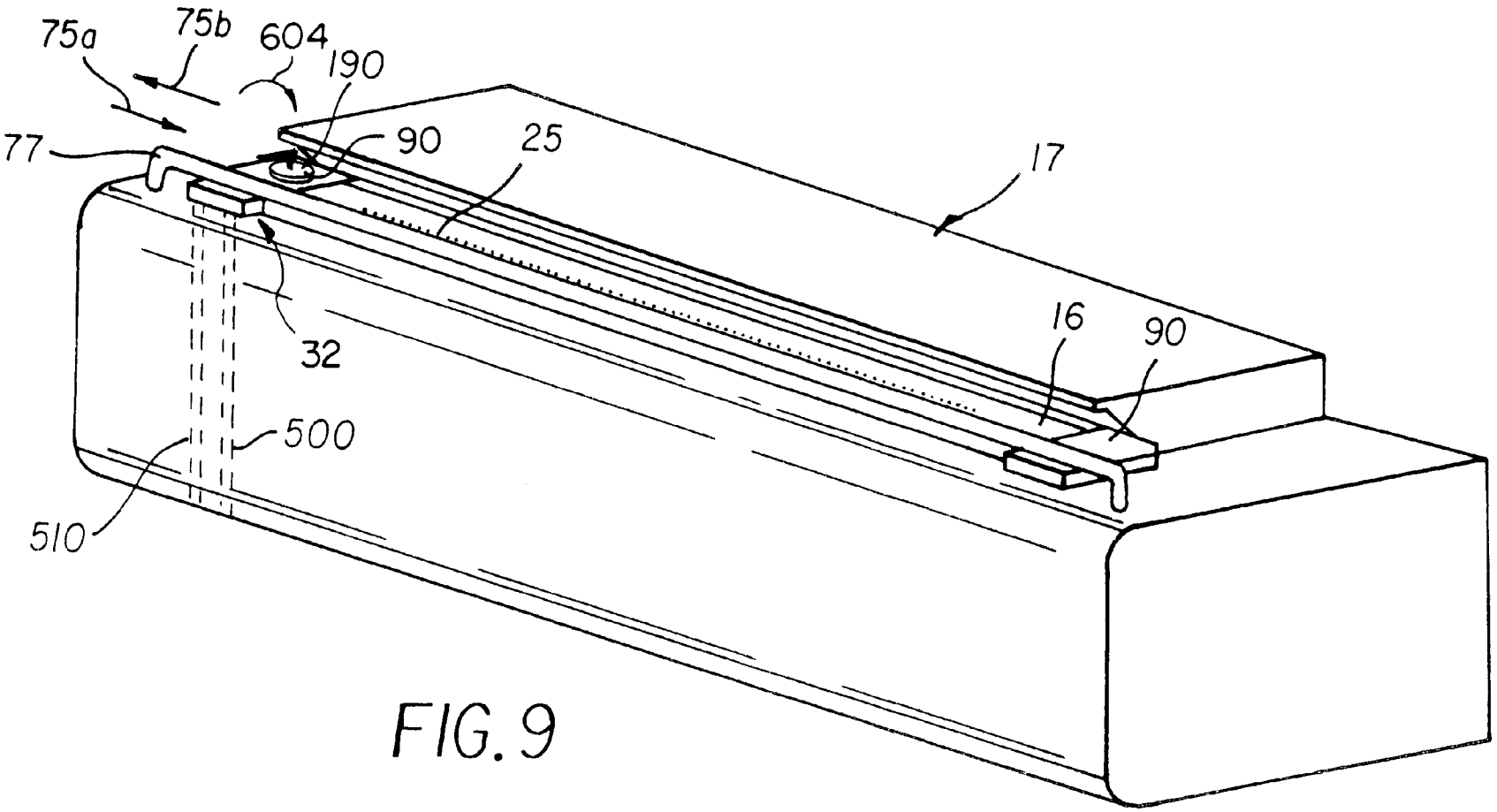
FIG. 9 shows an isometric view of print head with a rotating disk cleaning assembly aligned for widthwise translation.

Referring to FIGS. 8 and 9 therein is shown an example of a third embodiment self cleaning ink jet printer system, denoted generally as 430, in which a print head cleaning assembly 33 is provided on the same block as print head 16. In order to clean print head surface 15 and nozzles 25, disk 190 translates back and forth on guide rail 77 following arrows 75*a* and 75*b*. According to the third embodiment of printer system 430, rotating disk cleaning assembly 33 is mounted on print head 16 and pre-aligned with surface 15 and gutter 17. Upon receiving an appropriate electrical signal from cleaning assembly controller 40 and micro-controller 24, rotating disk cleaning assembly 33 is activated to translate along the direction of seventh arrow 75*a* using guide rail 77, as shown in FIG. 9. The motor driving the rotating disk cleaning assembly 33 is not shown.

As before, disk 190 is covered with a soft absorbent material 195 and may be cleaned on pad 90. Cleaning liquid 300 is supplied via duct 500 and recycled through duct 510. Further more, a separate duct (not shown) may be provided to supply vacuum suction to disk 190 during cleaning.

Figure 10:
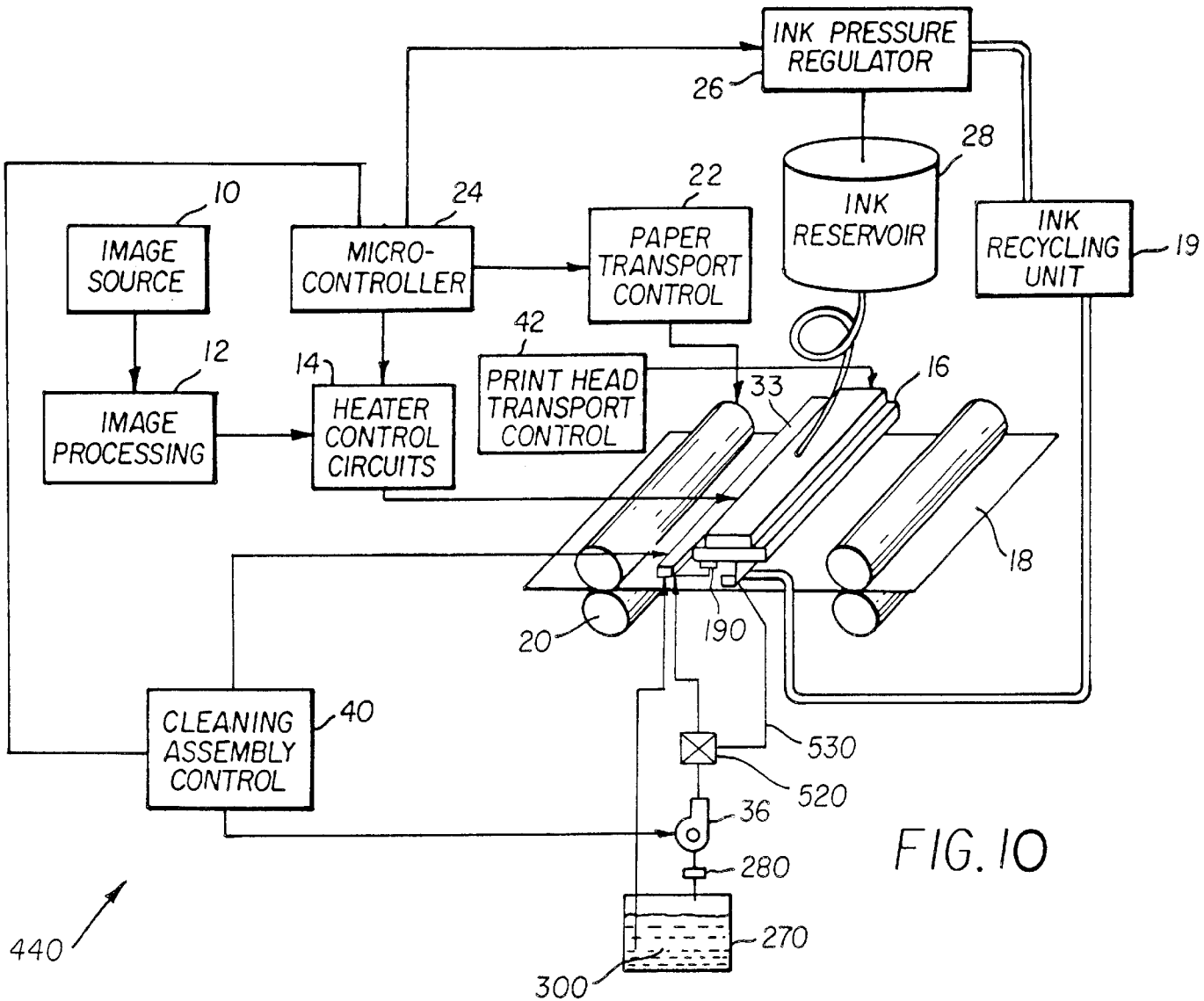
FIG. 10 is a simplified block schematic diagram of a fourth embodiment printer system equipped with a modified gutter for facilitating the flow of a cleaning liquid onto the rotating disk.
Figure 11:
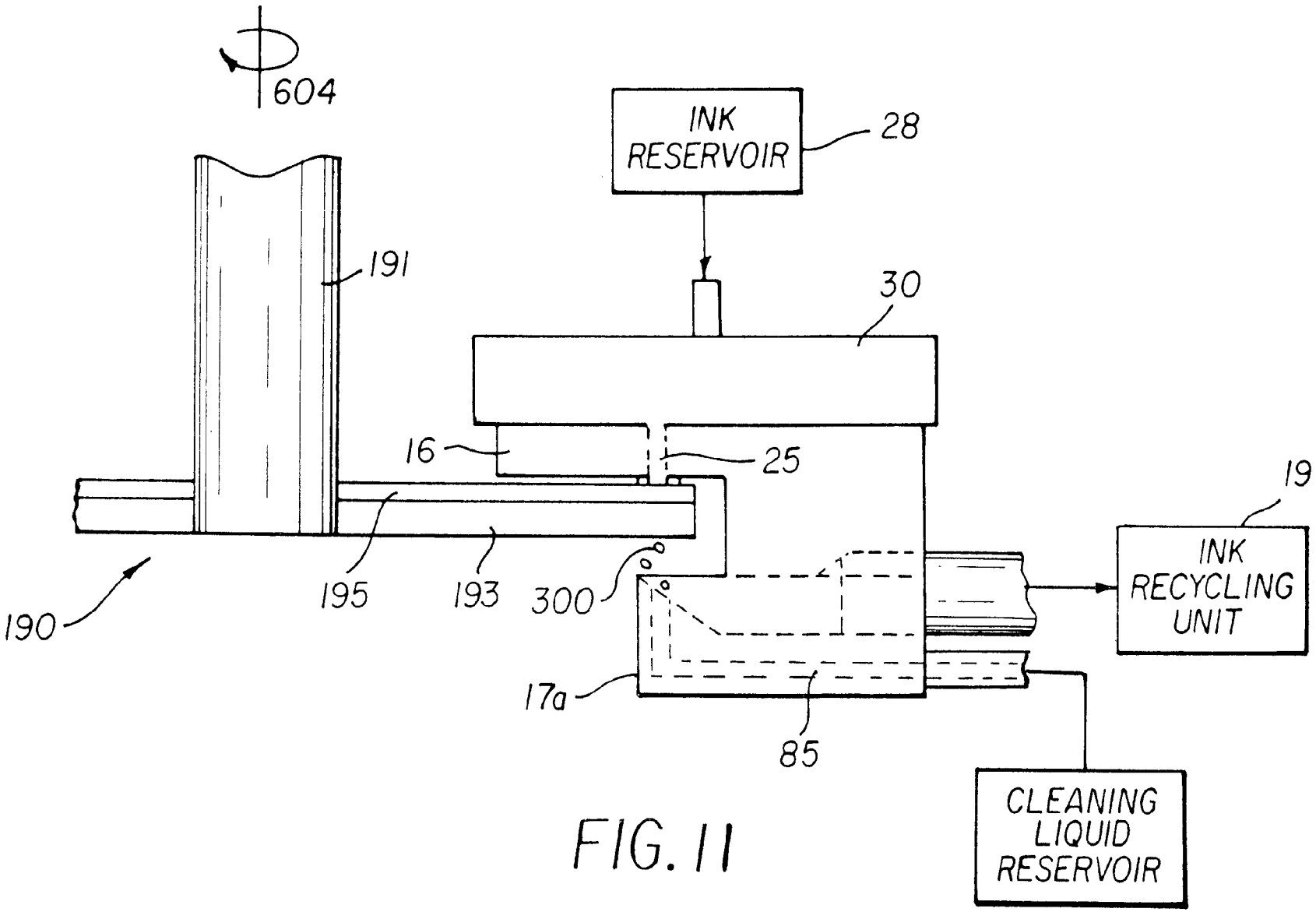
FIG. 11 is a side view of a print head with a modified gutter according to the fourth embodiment printer system shown in FIG. 10.

Referring to FIGS. 10 and 11 therein is shown an example of a fourth embodiment self cleaning ink jet printer system 440 capable of removing contaminant 55 from surface 15 and nozzles 25. In particular, ink jet printer system 440 has a disk 190 that is supplied with cleaning liquid 300 through modified gutter 17*a*. Cleaning liquid 300 is pumped to modified gutter 17*a* through valve 520 and piping segment 530 by pump 36. To facilitate the flow of cleaning liquid, modified gutter 17*a*has an internal duct 85, which delivers cleaning liquid 300 onto a soft absorbent covering 195 on the disk 190. Delivery of cleaning liquid through modified gutter 17*a* is compatible with previously discussed self cleaning printer systems, i.e., modified gutter 17*a*, valve 520 and piping segment 530 may readily be added to self cleaning printer systems 400, 410, 420 and 430.

While the invention has been described with particular reference to its preferred embodiments, it will be understood by those skilled in the art that various changes may be made and equivalents may be substituted for elements of the preferred embodiments without departing from the invention. For example, it will be appreciated that FIGS. 7, 8, 9, and 11 depict a page width print head by way of example only. Scanning type print heads that are smaller than page width size can also be cleaned using a variation of the method described above. In yet another variation, rather that use a cleaning liquid 300 for cleaning print head surface 15 and nozzles 25 of print head 16, ink 29 may be squirted out of nozzles 25 on to soft absorbent covering 195 on disk 190 during cleaning. At the end of the cleaning cycle, disk 190 and soft absorbent covering 195 may be cleaned with cleaning liquid 300 by the methods described above. In yet another variation, cleaning assemblies 32 and 33 may be coupled to an ultrasonic transducer to enhance cleaning of print head print head surface 15 and nozzles 25. In addition, many modifications may be made to adapt a particular situation and material to a teaching of the present invention without departing from the essential teachings of the invention.

PARTS LIST

| | |
|---|---|
| 10 | image source |
| 12 | image processing unit |
| 14 | heater control circuits |
| 15 | front surface |
| 16 | print head |
| 17 | gutter |
| 17a | modified gutter |
| 18 | recording medium |
| 19 | ink recycling unit |
| 20 | recording medium transport system |
| 21 | non-deflected ink drop |
| 22 | recording medium transport control system |
| 23 | deflected ink drop |
| 24 | micro-controller |
| 25 | nozzle |
| 26 | ink pressure regulator |
| 28 | ink reservoir |
| 29 | ink |
| 30 | ink channel device |
| 31 | ink channel |
| 32 | rotating disk cleaning assembly |
| 33 | rotating disk cleaning assembly on print head |
| 34 | vacuum pump |
| 36 | circulation pump |
| 38a | piping segment |
| 38b | piping segment |
| 40 | cleaning assembly motion control |
| 42 | cleaning assembly motion control |
| 44a | first arrow |
| 44b | second arrow |
| 6a | third arrow |
| 46b | fourth arrow |
| 50 | nozzle heaters |
| 55 | contaminant |
| 60 | ink droplet |
| 63 | first axis |
| 65 | second axis |
| 70a | fifth arrow |
| 70b | sixth arrow |
| 75a | seventh arrow |
| 75b | eighth arrow |
| 77 | guide rail |
| 79a | ninth arrow |
| 79b | tenth arrow |
| 90 | pad |
| 180 | cleaning assembly block |
| 190 | rotating disk |
| 191 | rotating shaft |
| 193 | perforated metal or plastic disk |
| 195 | soft absorbent covering |
| 300 | cleaning liquid |
| 400 | first embodiment printer system |
| 410 | second example of first embodiment printer system |
| 420 | third example of first embodiment printer system |
| 430 | third embodiment printer system |
| 440 | fourth embodiment printer system |
| 500 | supply duct |
| 510 | return duct |
| 520 | control valve |
| 530 | piping segment |
| 604 | arrows |

What is claimed:

1. A self-cleaning ink jet printer system, comprising:

a print head having a surface thereon;

an ink reservoir containing ink;

a gutter integrally connected to said print head for intercepting said ink in a non-printing mode; and a rotating disk cleaning assembly for cleaning said print head surface, said rotating disk cleaning assembly including a disk having a planar surface that interacts with said print head surface, said planar surface being flat such that the interaction of said, planar surface with said print head surface remains constant during cleaning.

2. The ink jet printer system of claim 1, wherein said rotating disk cleaning assembly comprises:

a shaft having an internal rotating member, said internal rotating member of said shaft connected to said disk for coming into direct rotating sliding contact with said print head surface to thereby remove contaminants from said print head surface; and a motor for driving said shaft.

3. The ink jet printer system of claim 2, further comprising an absorbent covering surrounding said disk.

4. The ink jet printer system of claim 3 further comprising a means for translating said rotating disk cleaning assembly towards said print head surface so that said soft covering touches said print head surface during rotation of said disk thereby permitting contaminants to be removed from said print head surface.

5. The ink jet printer system of claim 2, further comprising a cleaning assembly control configured to cause said rotating disk cleaning assembly to assume a cleaning position.

6. The ink jet printer system of claim 5, wherein said cleaning assembly control is further configured to cause said rotating disk cleaning assembly to assume a normal printing position after cleaning of said printer head surface.

7. The ink jet printer system of claim 2, further comprising a micro-controller configured to send an electronic signal that causes said print head to assume a maintenance position wherein said print head surface is translated towards said rotating disk cleaning assembly.

8. The ink jet printer system of claim 2, further comprising a block supporting said print head and wherein said rotating disk cleaning assembly is mounted on said block adjacent said print head.

9. The ink jet printer system of claim 8, further comprising a guide rail configured to permit said disk to translate along an areas spanned by said print head surface.

10. The ink jet printer system of claim 2, wherein said rotating disk cleaning assembly is mounted on said print head and pre-aligned with said print head surface.

11. The ink jet printer system of claim 1, further comprising a mounting block for supporting said rotating disk cleaning assembly.

12. The ink jet printer system of claim 1, further comprising:

a reservoir for storing a cleaning liquid;

a first piping segment providing a flow channel in a first direction between said reservoir and said rotating disk cleaning assembly; and a pump for directing a cleaning liquid from said reservoir to said rotating disk cleaning assembly via said first piping segment.

13. The ink jet printed system of claim 12, further comprising a second piping segment providing a flow channel in a second direction between said reservoir and said rotating disk cleaning assembly so that used cleaning liquid is returned to said cleaning reservoir.

14. The ink jet printer system of claim 1, wherein said disk surface is located on a radial surface of said disk.

15. A self-cleaning ink jet printer system comprising:

a print head having a surface thereon;

an ink reservoir containing ink;

a gutter integrally connected to said print head for intercepting said ink in a non-printing mode;

a rotating disk cleaning assembly for cleaning said print head surface, said rotating disk cleaning assembly including a disk; and an absorbent covering surrounding said disk, wherein said gutter further comprises an internal duct adapted to deliver a cleaning liquid to said absorbent covering.

16. A cleaning mechanism for a self-cleaning ink jet printer with a print head having a print head surface containing a plurality of orifices therein, said printer having a gutter integrally connected to said print head for intercepting ink in a non-printing mode, said cleaning assembly comprising:

a rotating disk cleaning assembly for cleaning said print head surface, said rotating disk cleaning assembly including a disk having a planar surface that interacts with said printhead surface, said planar surface being flat such that the interaction of said planar surface with said printhead surface remains constant during cleaning;

a means for moving, positioning, and aligning said rotating disk cleaning assembly;

a means for delivery of a cleaning liquid to said rotating disk cleaning assembly;

a vacuum pump to provide suctioning of said cleaning liquid; and a cleaning liquid reservoir, wherein said cleaning liquid is delivered to said rotating disk cleaning assembly by said means for delivery and suctioned back by said vacuum pump so that contaminants are removed from said print head surface through the suctioning action of said vacuum pump before being discharged into said cleaning liquid reservoir.

17. The cleaning mechanism of claim 16, wherein said rotating disk cleaning assembly further comprises:

a shaft connected to said disk for coming into direct contact with said print head to thereby remove contaminants from said print head surface; and a motor for driving said shaft.

18. The cleaning mechanism of claim 17, wherein said disk is surrounded by an absorbent covering that upon contact with said print head surface permits contaminants to be removed.

19. The cleaning mechanism of claim 16, further comprising a pump configured to assist in delivering cleaning liquid from said cleaning liquid reservoir to said rotating disk cleaning assembly.

20. The cleaning mechanism of claim 16, further comprising an ultrasonic transducer configured to assist in delivering cleaning liquid from said cleaning liquid reservoir to said rotating disk cleaning assembly.

21. The cleaning mechanism of claim 16 wherein said rotating disk cleaning assembly is mounted to said print head.

22. A cleaning mechanism for a self-cleaning ink jet printer with a print head having a print head surface containing a plurality of orifices therein, said printer having a gutter integrally connected to said print head for intercepting ink in a non-printing mode, said cleaning assembly comprising:

a rotating disk cleaning assembly for cleaning said print head surface;

a means for moving, positioning, and aligning said rotating disk cleaning assembly;

a means for delivery of a cleaning liquid to said rotating disk cleaning assembly;

a vacuum pump to provide suctioning of said cleaning liquid; and a cleaning liquid reservoir, wherein said cleaning liquid is delivered to said rotating disk cleaning assembly by said means for delivery and suctioned back by said vacuum pump so that contaminants are removed from said print head surface through the suctioning action of said vacuum pump before being discharged into said cleaning liquid reservoir and said means for delivery comprises an internal duct in said gutter.

23. In a self-cleaning ink jet printer, a method for cleaning an ink jet printer head having a print head surface thereon, said ink jet printer including a fixed gutter assembly, a rotating disk cleaning assembly for removing contaminants from said print head surface and a controller, said method comprising the steps of:

(a) translating said rotating disk cleaning assembly from a pre-defined home position to a cleaning position;

(b) causing said rotating disk cleaning assembly to come in contact with said print head surface and remove contaminants therefrom, said rotating disk cleaning assembly including a disk having a planar surface that interacts with said printhead surface, said planar surface being flat such that the interaction of said planar surface with said printhead surface remains constant during cleaning; and (c) translating said rotating disk cleaning assembly from said cleaning position to said defined home position.

24. The method of claim 23 further comprising the step of translating said print head to pre-defined maintenance position prior to said step of translating said rotating disk cleaning assembly to said cleaning position.

25. The method of claim 24 further comprising the step of translating said print head to a pre-defined printing position following said step of translating said rotating disk cleaning assembly from said cleaning position to said defined home position.

26. In a self-cleaning ink jet printer, a method for cleaning an ink jet printer head having a print head surface thereon, said ink jet printer including a fixed gutter assembly, a rotating disk cleaning assembly for removing contaminants from said print head surface and a controller, said method comprising the steps of:

translating said rotating disk cleaning assembly from a pre-defined home position to a cleaning position;

causing said rotating disk cleaning assembly to come in contact with said print head surface and moving said rotating disk cleaning assembly at a pre-determined speed and for a pre-determined distance in order to avoid colliding with said fixed gutter assembly; and translating said rotating disk cleaning assembly from said cleaning position to said defined home position.

* * * * *